US010914132B1

(12) United States Patent
Pang et al.

(10) Patent No.: US 10,914,132 B1
(45) Date of Patent: Feb. 9, 2021

(54) LARGE-DIAMETER SOLUBLE BRIDGE PLUG

(71) Applicant: PETRO-KING ENERGY TECHNOLOGY (HUIZHOU) CO., LTD., Huizhou (CN)

(72) Inventors: Ruijie Pang, Huizhou (CN); Jiangping Li, Huizhou (CN); Renjin Chen, Huizhou (CN); Jianfeng Liu, Huizhou (CN)

( * ) Notice: Subject to any disclaimer, the term of this patent is extended or adjusted under 35 U.S.C. 154(b) by 0 days.

(21) Appl. No.: 16/664,796

(22) Filed: Oct. 26, 2019

(51) Int. Cl.
*E21B 33/129* (2006.01)

(52) U.S. Cl.
CPC ..... *E21B 33/1293* (2013.01)

(58) Field of Classification Search
CPC ..... E21B 33/134; E21B 33/1293
See application file for complete search history.

(56) References Cited

U.S. PATENT DOCUMENTS 3,433,301 A * 3/1969 McEver, Jr. ..... E21B 33/134 166/128
10,316,611 B2 6/2019 Wutherich
2011/0048743 A1 3/2011 Stafford et al.
2011/0162844 A1* 7/2011 Mauth ..... E21B 33/14 166/285
2015/0354310 A1 12/2015 Zaiser
2017/0130553 A1* 5/2017 Harris ..... E21B 33/1208
2020/0072021 A1* 3/2020 Zhao ..... E21B 43/261
2020/0157914 A1* 5/2020 Graham ..... E21B 33/134
2020/0173246 A1* 6/2020 Kellner ..... E21B 33/128

FOREIGN PATENT DOCUMENTS

CN 108894749 A 11/2018
CN 110259413 A 9/2019

* cited by examiner

*Primary Examiner* — Kristyn A Hall
(74) *Attorney, Agent, or Firm* — Erson IP (Nelson IP)

(57) ABSTRACT

The present invention relates to the technical field of downhole tools of oil-gas wells, and specifically discloses a large-diameter soluble bridge plug. The large-diameter soluble bridge plug includes a fracturing ball, a cone, slips and a guide shoe. The lower end of the cone is connected with the upper end of the slips; the lower end of the slips is connected with the upper end of the guide shoe; a sealing component is arranged at a joint of the cone and the slips; and the fracturing ball is connected with the upper end of the cone in a sealing manner. A shear pin hole is formed at the upper end of the cone; and a groove is formed in an internal surface of the lower end of the guide shoe.

7 Claims, 4 Drawing Sheets

LARGE-DIAMETER SOLUBLE BRIDGE PLUG

CROSS-REFERENCE TO RELATED APPLICATIONS

This application claims priority to Chinese Patent Application No. 201911105995.7 with a filing date of Nov. 13, 2019. The content of the aforementioned applications, including any intervening amendments thereto, are incorporated herein by reference.

TECHNICAL FIELD

The disclosure relates to the technical field of oil exploitation, and more specifically to a hard-sealing soluble bridge plug.

BACKGROUND OF THE PRESENT INVENTION

Currently, layered fracturing and exploitation of unconventional oil and gas is mainly based on the staged fracturing of a composite bridge plug, but after the fracturing of the composite bridge plug is completed, coiled tubing drilling mill needs to be used to remove the fracturing so as to restore the diameter of a wellbore; drilling mill needs to use tools such as a coiled tubing truck, a coiled tubing down hole tool, milling shoes and the like, and thus is high in operation cost and high in operation risk for small wells and over-deep wells.

With the increasing depth of unconventional oil and gas exploitation, the utilization of the coiled tubing drilling mill is more and more difficult, and therefore a soluble bridge plug occurs. The soluble bridge plug has been increasingly applied in the staged fracturing construction of unconventional oil and gas. After the construction of the soluble bridge plug is finished, any posttreatment is not needed, and there is no debris left in the well. It has achieved good economic and social benefits when being used in the perforation fracturing and continuous operation process.

However, at present, the conventional soluble bridge plug in the market adopts a structure of soluble Mg—Al alloy+soluble rubber cylinder (aged elastic sealing rubber cylinder), which is not distinctly different from the structure of the original cast iron bridge plug, and the structures have not been disruptively changed. Such the structure has the following limitations: (1) in order to maintain its original mechanical properties, the soluble rubber cylinder must strictly control the storage environment, temperature, light, solvent avoidance and the like after production, thereby leading to higher management cost of equipment when in field construction and operation, for example, the performance and quality of the product cannot be effectively evaluated and judged due to too-long storage time; (2) the hardness of the soluble rubber material is relatively low, which has great limitation to the pressure bearing capacity of the soluble bridge plug, so that the soluble bridge plug in the prior art has the defects of poor sealing effect, hand off or easy fracturing failure, poor anchoring effect and the like in practice; (3) the soluble rubber cylinder is slowly dissolved or difficultly dissolved due to its large volume, when the soluble bridge plug is dissolved, the soluble metal body can be dissolved prior to the soluble rubber cylinder, so as to result in that the rubber cylinders which are not dissolved can be accumulated together to block the wellbore during flowback without fixation of the metal body; (4) after setting of the single-slip soluble bridge plug having the existing structure, the wedge will stretches and anchors the slip, the rebound force of the rubber cylinder and slip might cause the wedge to rolled out, resulting in poor anchoring effect and easy slippage during the bridge plug fracturing; (5) the existing soluble bridge plug needs to use multiple retaining rings to protect the sealing performance of the soluble rubber cylinder, the retaining ring is the weakest point and may be broken or fail to support in place under high pressure and result to unable to be sealed; (6) each temperature level needs to correspond to the same temperature level of the rubber cylinder, so the temperature adaptability is not strong.

SUMMARY OF PRESENT INVENTION

The objective of the disclosure is to provide a hard-sealing soluble bridge plug, solving the problems in the prior art that the soluble rubber cylinder generates the above defects when in sealing.

The technical solution to solve the technical problem in the disclosure is as follows: a hard-sealing soluble bridge plug comprises a body made of soluble metal, the body comprises a wedge, a slip and a guide shoe which are connected from top to bottom in turn, at least one metal sealing ring is sleeved at the junction of the outer circumference of the wedge and the slip, and the metal sealing ring is made of soluble metal.

In the hard-sealing soluble bridge plug of the disclosure, the upper end of the wedge is provided with a setting shear screw hole for preventing accidents, the setting shear screw hole is used for connecting the wedge to a setting adapter through installation of a shear screw, the guide shoe is provided with shear screw hole which is used for connecting the guide shoe to the setting adapter through installation of a shear screw.

In the hard-sealing soluble bridge plug of the disclosure, the outer surface of the lower end of the wedge is provided with inverted teeth-shaped external gearing tooth, the inner surface of the slip is provided with internal gearing tooth mutually engaged with the external gearing tooth after setting of the hard-sealing soluble bridge plug.

In the hard-sealing soluble bridge plug of the disclosure, the guide shoe is provided with an overflowing hole.

In the hard-sealing soluble bridge plug of the disclosure, the outer surface of the slip is inlaid with a ceramic granule, and an angle between the axial direction of the ceramic granule and the axial direction of the slip ranges from 75° to 80°.

In the hard-sealing soluble bridge plug of the disclosure, the lower end of the slip is upwardly provided with first open grooves, the upper ends of the first open grooves are provided with stress release holes; the upper end of the slip is downwardly provided with second open grooves, the lower ends of the second open grooves are provided with stress release holes, the first open grooves and the second open grooves are uniformly spaced on the slip at regular intervals.

In the hard-sealing soluble bridge plug of the disclosure, the lower end face of the slip is upwardly and inwardly sunken to form a first conical surface, the outer end face of the upper end of the guide shoe forms a second conical surface adaptive to the first conical surface, and the first conical surface and the second conical surface are inclined by 40-50° relative to the axial direction of the body.

In the hard-sealing soluble bridge plug of the disclosure, the inner surface of each of the metal sealing rings clings to the outer surface of the wedge, the outer surface of each of the metal sealing rings forms a sharp corner shape, the upper surface of the sharp corner of the uppermost metal sealing rings and the axial direction of the body forms an inclined angle of 25-35°.

In the hard-sealing soluble bridge plug of the disclosure, the outer diameter of each of the metal sealing rings from top to bottom are successively shortened.

In the hard-sealing soluble bridge plug of the disclosure, the soluble metal is soluble Mg—Al alloy.

The hard-sealing soluble bridge plug implementing the disclosure has the following beneficial effects: the hard-sealing soluble bridge plug of the disclosure is sealed by using the metal sealing ring of soluble metal, which has the following advantages without affecting the whole dissolution of the soluble bridge plug: (1) the hard-sealing soluble bridge plug is easy to store and has no aging problem; (2) the material is high in hardness, high in pressure-resistant property and strong in temperature adaptability; (3) when in setting, the soluble bridge plug is good in sealing effect without the retaining ring; (4) after the setting of the soluble bridge plug, the wedge stretches the slip, the wedge cannot easily slip out from the slip; (5) after the setting of the soluble bridge plug, the stretching sizes of the upper end and lower end of the slip are balance, thereby improving the firmness of anchoring; (6) the metal sealing ring of soluble metal and the soluble metal body are almost synchronously dissolved, which does not cause the phenomenon of blocking the wellbore when flowback, and therefore the hard-sealing soluble bridge plug of the disclosure can effectively improve the fracturing operation efficiency and eliminating the risk of blocking the wellbore, and is compact in structure so as to improve the performance stability of the soluble bridge plug.

DETAILED DESCRIPTION OF PREFERRED EMBODIMENTS

Figure 1:
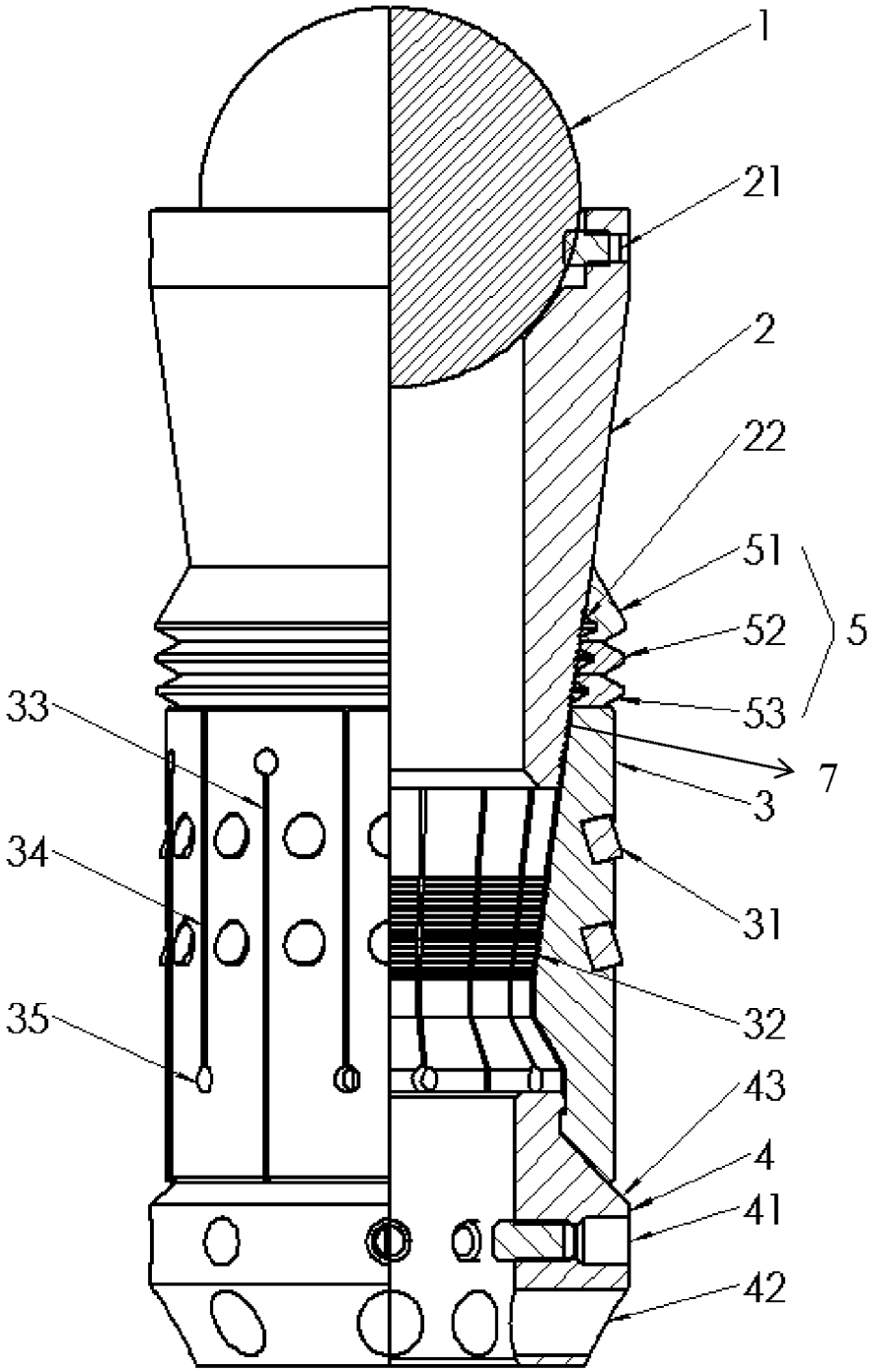
FIG. 1 is a structural diagram of the state in which the hard-sealing soluble bridge plug of the disclosure is configured with a fracturing ball.

The structure and action principle of the hard-sealing soluble bridge plug of the disclosure are further described in combination with drawings and embodiments.

In the description of the disclosure, it is to be understood that the terms "center", "longitudinal", "horizontal", "upward", "downward", "front", "rear", "left", "right", "vertical", "horizontal", "top", "bottom", "inside", "outside", "clockwise", "anticlockwise" and other indicating directions or position relations are based on directions or position relations shown in the drawings, are only for facilitating the description of the disclosure and simplifying the description, rather than indicating or implying that the device or element must have a specific orientation and is constructed and operated in a specific orientation, and thus cannot be understood as limiting the disclosure.

Figure 2:
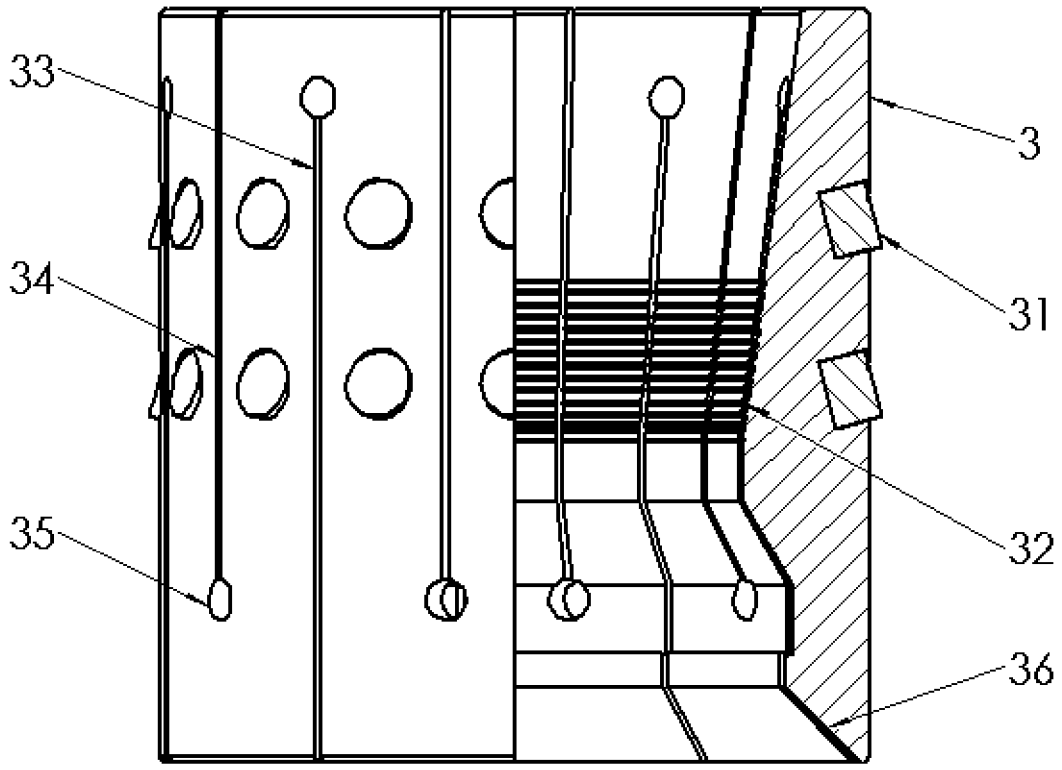
FIG. 2 is a structural diagram of the slip of the disclosure.

As shown in FIGS. 1-2, a preferred embodiment of the disclosure provides a hard-sealing soluble bridge plug, and particularly provides a full-metal hard-sealing soluble bridge plug. The hard-sealing soluble bridge plug comprises a body made of soluble metal, the body comprises a wedge 2, a slip 3 and a guide shoe 4 which are connected from top to bottom in turn, at least two metal sealing rings 5 are sleeved at the junction 7 of the outer circumference of the wedge 2 and the slip 3, the metal sealing rings 5 are made of soluble metal, wherein the soluble metal is mainly soluble Mg—Al alloy having high elongation, wherein the elongation is preferably >25%. The soluble Mg—Al alloy can adopt SD001 brand of Mg—Al alloy and the like produced from Shenzhen Sude Technology Co., Ltd, and certainly, can also be soluble Mg—Al alloy produced from other manufacturers, but is not limited thereto.

The quantity of the metal seal rings 5 is determined as needed. Preferably, the quantity of the metal seal rings 5 is 3, comprising a first metal sealing ring 51, a second metal sealing ring 52 and a third metal sealing ring 53, and the three layers of metal seal rings 5 make the seal more secure. When the metal sealing ring 5 is stretched, when one layer of metal sealing ring 5 is stretched and broken, it is ensured that at least two layers of metal seal rings 5 play a role of sealing, which improves the reliability of the bridge plug seal.

The metal sealing ring made of soluble metal replaces the traditional soluble rubber cylinder seal and has the following advantages:

(a) The metal sealing ring is convenient to store, does not need to be sealed and stored in vacuum (exposed preservation at room temperature), and is difficultly out of the date and aged;

(b) The metal sealing ring is made of soluble metal having high elongation, so that it is not easy to deform under high pressure, and the soluble metal material is not easy to shrink and rebound when being stretched;

(c) The soluble metal material is strong in temperature adaptability, and can adapt to the underground operation of the most bridge plugs having different temperature grades;

(d) Due to the strong crushing resistance of the soluble metal material, adoption of the metal sealing ring can perform firm sealing without protection of the retaining ring, and there is no risk of retaining ring breaking or supporting in place so that the seal is more stable and reliable.

An angle range between the inner surface of each metal sealing ring 5 and the axial direction of the body is a conical surface of 5-10°, The angle between the outer surface of the wedge 2 and the axial direction of the body is the same as that between the inner surface of the metal sealing ring 5 and the axial direction of the body, which is also a conical surface of 5-10 degrees. The angle between the outer surface wedge of the wedge 2 and the axial direction of the body is the same as the wedge surface angle set on the inner surface of the metal sealing ring 5. The metal sealing ring 5 close to a sleeve is larger in area, more uniform in sealing and better in sealing effect.

Where, the inner surface of each metal sealing ring 5 clings to the outer surface of the wedge 2, and the outer surface of each metal sealing ring 5 forms a sharp angle shape. Through this design, adjacent metal seal rings 5 are of indentation, and the sharp angle of the metal sealing ring 5 is more easily squeezed when setting. At the same time, they can be stacked towards gaps at two sides of the sharp angle after squeezing, thus forming a good sealing effect.

The upper surface of the sharp angle of the uppermost metal sealing ring 5 and the axial direction of the body form an inclined angle of 25-35°, preferably 30°, to guide the overflowing of the upper fluid and protect the metal sealing ring 5 from being damaged by the erosion of the upper fluid.

The outer diameters of the metal sealing rings 5 from top to bottom on the wedge 2 are successively shortened. Take the three layers of metal seal rings 5 as an example, the outer diameter of the first metal sealing ring 51 is larger than the outer diameter of the second metal sealing ring 52; the outer diameter of the second metal sealing ring 52 is larger than the outer diameter of the third metal sealing ring 53, so that the three metal seal rings 5 successively expand and stick to the wall of the sleeve, and then the slip 3 is anchored to the sleeve so that the metal sealing ring 5 is more easily squeezed and deformed between the wedge 2 and the sleeve so as to ensure the sealing effect of the metal sealing ring 5.

The upper end of the wedge 2 is provided with a setting shear screw hole 21 for preventing accidents. The setting shear screw hole 21 is used to connect the wedge 2 to the setting adapter 6 through installation of the shear screw 65. In this way, the wedge 2 can be directly fixed on the setting adapter 6, so as to prevent the soluble bridge plug from stretching the slips 3 to cause the accidental setting for unexpected reasons of blocking the wedge 2 during the well entry. It should be noted that after running in the well, the setting adapter 6 is finally separated from the wedge 2. As shown in FIG. 1, the fracturing ball 1 is finally sealed at the upper end of the wedge 2.

The guide shoe 4 is provided with a hands-off shear screw hole 41 which is used for connecting the guide shoe to the setting adapter 6 though installation of the hands-off shear screw 66.

Figure 3:
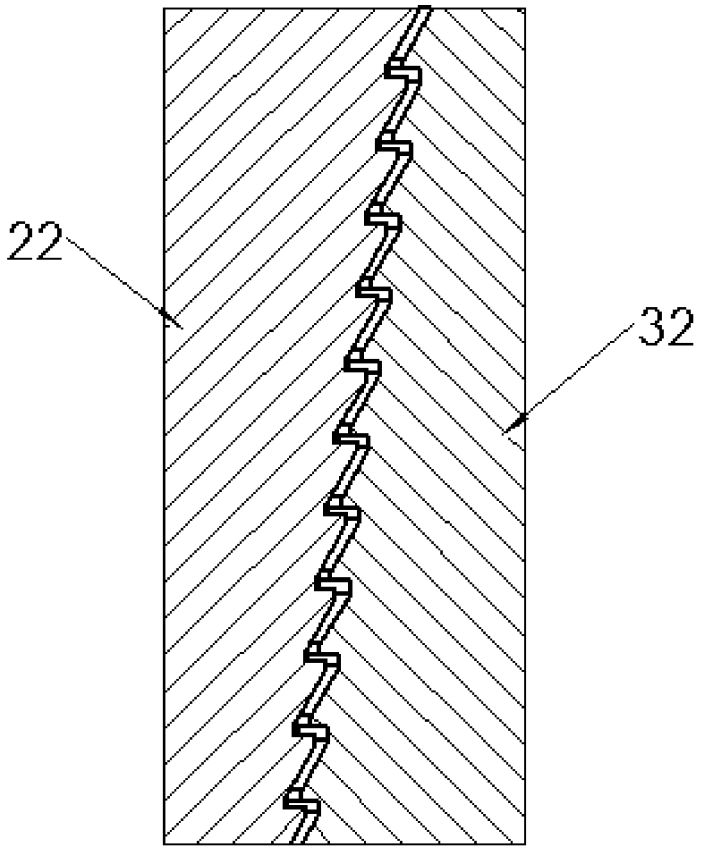
FIG. 3 is a state diagram of a mutual engagement state of external gearing tooth on the wedge and internal gearing tooth on the slip.

As shown in FIG. 3, the outer surface of the lower end of the wedge 2 is provided with inverted teeth-shaped external gearing tooth 22 for anti-skidding, and the inner surface of the slip 3 is provided with internal gearing tooth 32 for mutually engaging with the external gearing tooth 22 after the hard-sealing soluble bridge plug is set. That is to say, no engage connection occurs between the external gearing tooth 22 and the internal gearing tooth 32 before setting of the hard seal soluble bridge plug, and occurs only after the setting is pressed. By adding special engaging inverted tooth at the junction of the wedge 2 and the slip 3, the contact sliding resistance of the wedge 2 and the slip 3 increases without affecting the advance of the setting at the same time, the wedge 2 is difficult to slide off from the slip 3, the slip 3 is more stable to anchor, and the reliability of bridge plug construction is more improved.

The inner surface of the lower end of the slip 3 is provided with an internal latching slot, and the upper outer surface of the guide shoe 4 is provided with an external latching slot. The internal latching slot and the external latching slot are in match connection so that the connection between the slip 3 and the guide shoe 4 is firm, the bridge plug is prevented from setting in advance when entering the well, and the use stability is improved.

The guide shoe 4 is provided with an overflow hole 42. The overflow hole 42 can prevent backflow from blocking the backflow channel on the fracturing ball 1 on the previous layer interval when blowoff and backflow after fracturing, so as to ensure that the backflow channel is unobstructed.

The outer surface of the slip 3 is inlaid with ceramic granules 31. The angle range between the axial direction of the ceramic granule 31 and the axial direction of the slip 3 is 75-80 degrees, which plays the role of anchoring the bridge plug on the sleeve. Where, the ceramic granules 31 are made of high-strength ceramics. As shown in FIG. 1, the axial direction of the ceramic granule 31 is a direction that is slightly upwardly inclined toward the right in the direction shown in the drawing.

The lower end of the slip 3 is upwardly provided with first open grooves 33, and the upper ends of the first open grooves 33 are provided with stress release holes; the upper end of the slip 3 is downwardly provided with second open grooves 34, and the lower ends of the second opening grooves 34 are provided with stress release holes, and the first open grooves 33 and the second open grooves 34 are uniformly spaced on the slip 3 at regular intervals. The first opening grooves 33 and the second opening grooves 34 make the slip 3 evenly open when in setting of the bridge plug, while the stress release holes do not directly tear the first open grooves 33 and the second open grooves 34 when the slip 3 is opened, and the breaking possibility of the slip 3 is not caused.

In the setting process of the single slip soluble bridge plug having the existing structure, the wedge stretches and anchors the slip from the upper end, while the lower end of the slip is not provided with a stretching structure, which easily makes the opening diameter of the upper end of the slip larger than the opening diameter of the lower end, resulting in the phenomenon that the lower row of the slip is not anchored or the anchoring is not stable. In this preferred embodiment, the lower end face of the slip 3 is concave upwardly to form a first wedge 36, the outer end face of the upper end of the guide shoe 4 forms a second wedge 43 adaptive to the first wedge 36 of the slip, the first wedge 36 and the second wedge 43 are inclined by 40-50 degrees relative to the axial direction of the body, preferably, the first wedge 36 and the second wedge 43 are inclined by 45 degrees relative to the axial direction of the body, so that the second conical surface 43 of the guide shoe 4 generates a force acting on the outward stretching of the slip 3 in the process of setting the soluble bridge plug, which makes the stretching degrees of the upper end and the lower end of the slip 3 balanced, thereby promoting the stability of anchoring.

Figure 4:
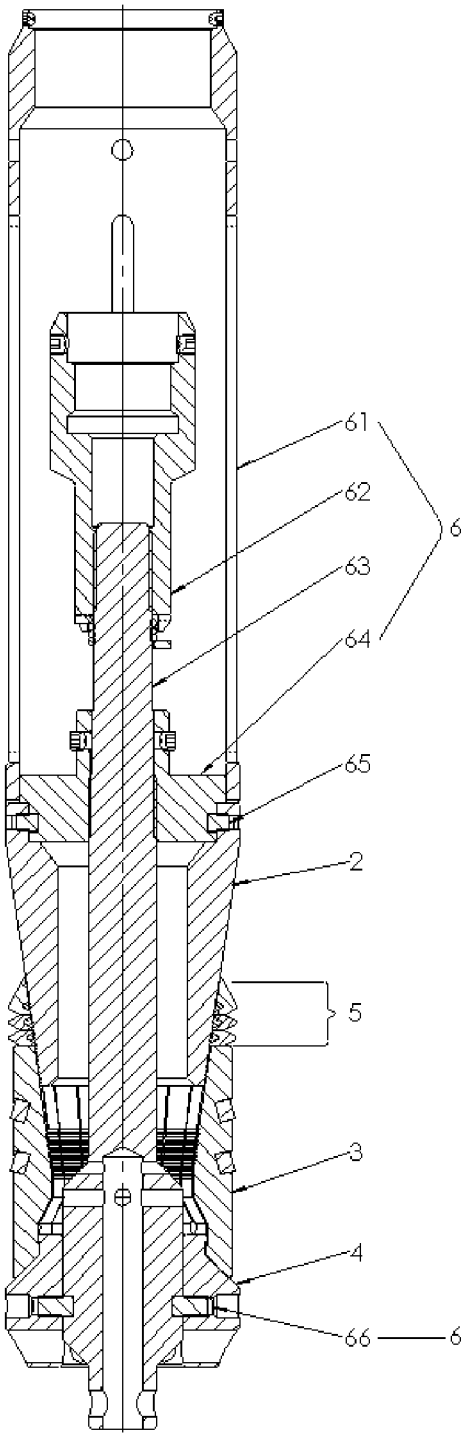
FIG. 4 is a structural diagram of a state in which a hard seal soluble bridge plug of the disclosure is configured with a setting adapter.

FIG. 4 shows the setting adapter 6 used in this embodiment, which includes a push cylinder 61, an adapter 62, a connecting rod 63, an adjusting nut 64, a shear screw 65 and a release shear screw 66. The hard-sealing soluble bridge plug of this embodiment needs to be matched with the setting adapter 6 when being fed and set. After the completion of the first section of perforating and fracturing in the staged fracturing operation, a hard-sealing soluble bridge plug tool string is put, the hard-sealing soluble bridge plug has the function of preventing accident and setting in advance. The wedge 2 is fixed on the setting adapter 6 by the shear screw 65, the slip 3 and the guide shoe 4 are in matching connected by the inner and external latching slots, and the guide shoe 4 is fixed on the setting adapter 6 by the release shear screw 66, so parts on the hard-sealing soluble bridge plug are directly or indirectly fixed on the setting adapter 6, which prevents the hard-sealing soluble bridge plug from generating accidents and setting in advance when entering the well. After the tool string enters the design depth, setting is started through cable ignition or hydraulic pressure, and the setting tool generates a thrust to push the push cylinder 61 of the setting adapter 6 to downwardly move, so as to push the wedge 2 to downwardly move. Because the conical surface of the wedge 2 is inclined, the wedge 2 downwardly moves so that the metal sealing ring 5 assembly is stretched and the slip 3 is stretched. When the metal sealing ring 5 completely fits the inner wall of the sleeve and has a certain interference squeezing. After the slip 3 is anchored to the inner wall of the sleeve, the setting and hanging of the hard-sealing soluble bridge plug are completed. At this moment, the wedge 2 and the slip 3 have been firmly wedged together and cannot continue downward moving. After the setting of the hard-sealing soluble bridge plug is completed, the thrust generated by the setting tool continues increasing. When the thrust is increased to the shear force of the release shear screw 66, the release shear screw 66 is sheared to realize the separation of the setting adapter 6 and the hard-sealing soluble bridge plug. The tool string upwardly lifts for a certain distance to a predetermined position for perforation, and then the tool string is taken out and the fracturing ball 1 is put to make it fall freely or pump to the position of the set hard-sealing soluble bridge plug to perform fracturing operation. At this moment, the fracturing ball 1 seals the upper end of the wedge 2, and the ring space between the wedge 2 and the sleeve is sealed by the metal sealing ring 5, which realizes the sealing and insulation of upper and lower fracturing layers. After the fracturing operation is completed, the blowoff and flowback is carried out. The electrolyte-containing solution flowback from the bottom layer of the hard-sealing soluble bridge plug can completely dissolve the hard-sealing soluble bridge plug. After the hard-sealing soluble bridge plug is dissolved, the wellbore reaches the full diameter, thereby improving the operability of various operations of oil and gas wells in the later stage.

In conclusion, the hard-sealing soluble bridge plug provided by the disclosure can be applied to the field of oil and gas well fracturing and production increase, is easier to store, more stable to seal and more firm to anchor, is effectively improved in the setting success rate, and better adapts to the downhole environment. Furthermore, due to its simple and compact structure, the soluble bridge plug is easy to machine and manufacture, and the cost of the soluble bridge plug is effectively reduced.

It should be understood that for those skilled in the art, improvements or transformations can be made according to the above description, but these improvements or transformations shall fall within the scope of protection of the appended claims of the disclosure.

We claim:

1. A large-diameter soluble bridge plug, comprising a fracturing ball, a cone, a plurality of slips and a guide shoe; wherein a lower end of the cone is connected with the upper end of the slips; the lower end of the slips is connected with the upper end of the guide shoe; a sealing component is arranged at a joint of the cone and the slips; the fracturing ball is connected with the upper end of the cone in a sealing manner; a shear pin hole is formed at the upper end of the cone; and a groove is formed in an internal surface of the lower end of the guide shoe the sealing component successively comprises a sealing ring, a first sealing support ring and a second sealing support ring; a first gap is formed on the first sealing support ring; a second gap is formed on the second sealing support ring; and the first gap and the second gap are staggered at 180 degrees.

2. The large-diameter soluble bridge plug of claim 1, wherein a chamfer is formed on the internal surface of the lower end of the cone.

3. The large-diameter soluble bridge plug of claim 1, wherein an overflowing hole is formed in the guide shoe.

4. The large-diameter soluble bridge plug of claim 3, wherein the internal surface of the sealing ring a conical surface.

5. The large-diameter soluble bridge plug of claim 1, wherein tooth particles are embedded on the external surfaces of the slips.

6. The large-diameter soluble bridge plug of claim 5, wherein the tooth particles are alloy or ceramic tooth particles.

7. The large-diameter soluble bridge plug of claim 1, wherein a first open slot is formed at the upper end of the slips; a second open slot is formed at the lower end of the slips; and the first open slot and the second open slot are arranged on the slips at a uniform interval.

* * * * *